United States Patent [19]

Seybold

[11] 4,016,521

[45] Apr. 5, 1977

[54] THERMAL LIMITER

[76] Inventor: Joseph F. Seybold, % Accurate Electronics Corp., 169 S. Abbe Road, P. O. Box R, Elyria, Ohio 44035

[22] Filed: May 23, 1975

[21] Appl. No.: 580,230

[52] U.S. Cl. ..... 337/241; 337/163; 337/265

[51] Int. Cl.[2] ..... H01H 81/30

[58] Field of Search ..... 337/163, 164, 165, 182, 337/186, 222, 241, 242, 243, 265

[56] References Cited

UNITED STATES PATENTS

| | | | |
|---|---|---|---|
| 891,414 | 6/1908 | Ernst | 337/241 |
| 1,450,670 | 4/1923 | La Mao | 337/241 |
| 1,650,996 | 11/1927 | McDonnell | 337/241 |
| 3,180,958 | 4/1965 | Merrill | 337/413 X |
| 3,649,942 | 3/1972 | Plasko | 337/163 |

*Primary Examiner*—J D Miller
*Assistant Examiner*—Fred E. Bell
*Attorney, Agent, or Firm*—McNenny, Pearne, Gordon, Gail, Dickinson & Schiller

[57] ABSTRACT

A thermal limiter assembly for controlling an electrical circuit in response to the existence of a sensed condition beyond a predetermined time period. A housing body of the assembly includes a gas-filled cavity in which are disposed functional electrical elements in the form of a heater element and a thermally responsive switch or fuselike element. The heater element is arranged to raise the temperature of the thermally responsive element to a critical temperature at which it changes its state of conductivity and is thereby adapted to alter an external circuit connected to it. As disclosed, the heat transfer relationship between the heater element and the thermally responsive element is relatively independent of environmental temperature conditions so that the time period to actuate the thermally responsive element is not substantially affected by such temperature conditions. The housing body includes means to indicate the state of conductivity of the thermally responsive device in a visually perceptible manner externally of said housing.

4 Claims, 7 Drawing Figures

Fig. 1
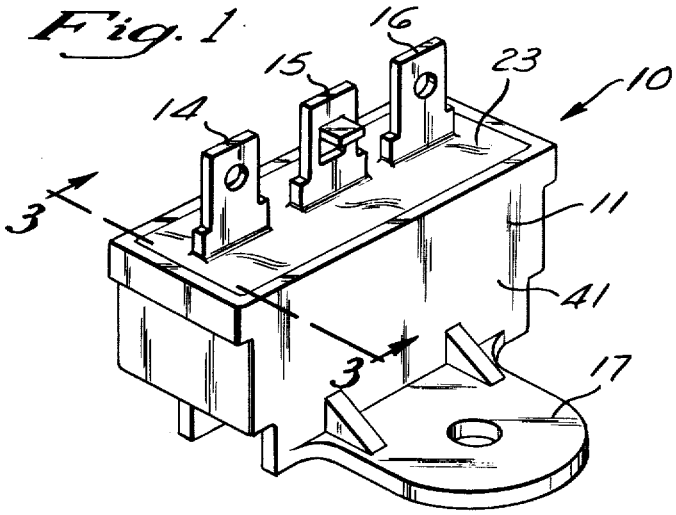
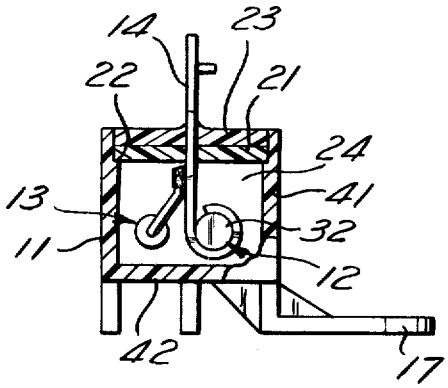
Fig. 3
Fig. 2
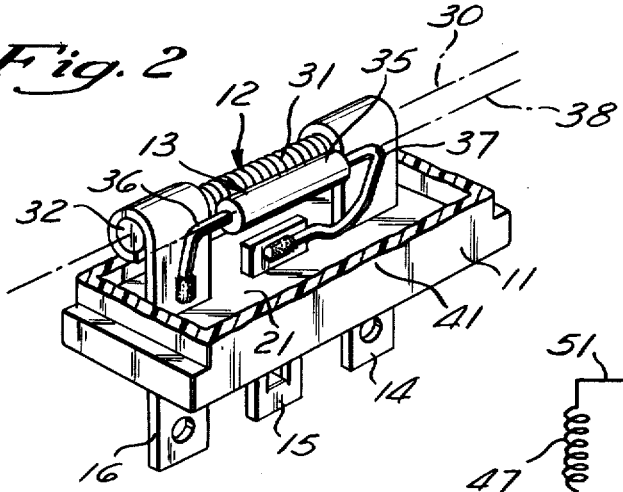
Fig. 5
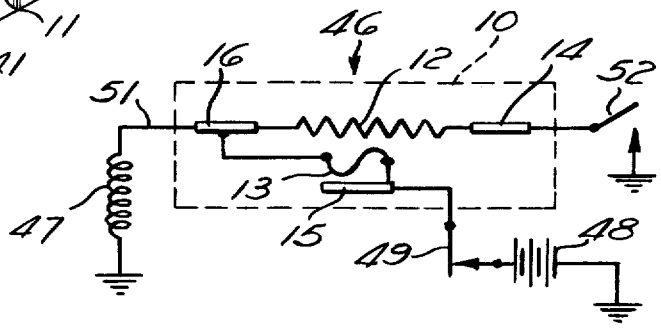
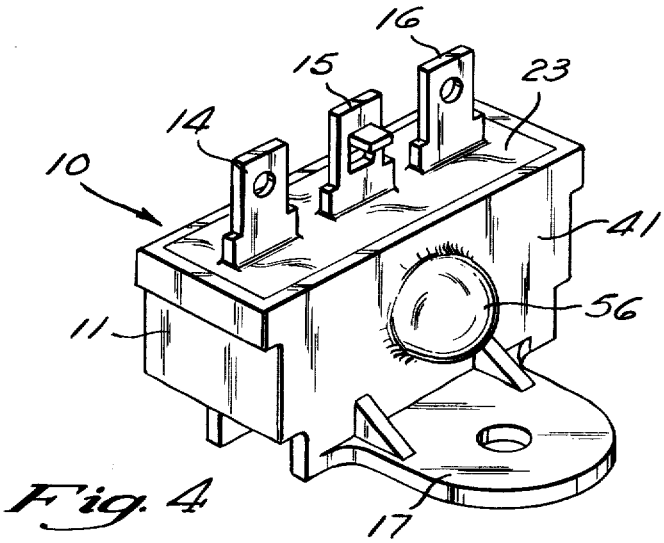
Fig. 4
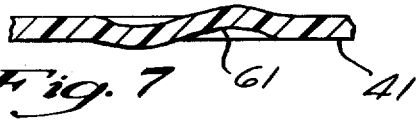
Fig. 7
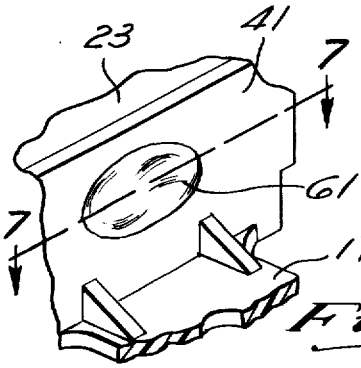
Fig. 6

THERMAL LIMITER

BACKGROUND OF THE INVENTION

The invention relates to devices for controlling electrical circuits, and in particular is directed to improvements in thermal limiter devices.

PRIOR ART

U. S. Pat. Nos. 3,649,942 and 3,764,948, both to Plasko, disclose thermal limiter devices adapted for use in protecting or otherwise controlling electrical circuits. The principle involved in devices of this type is the transfer of heat energy from an electrical heater element, operated when a specific or unusual condition occurs and/or persists beyond a predetermined time period, to a thermally responsive element to change its state of conductivity and thereby alter the continuity of an associated circuit.

It has previously been taught, as in the aforementioned patents, that the requisite performance of such devices could only be achieved by embedding the thermally responsive and heater elements in a solid insulating coating mass. It has been suggested that this embedding approach was necessary to achieve a critical heat transfer relationship between these electrical elements to develop a controlled time delay.

Among the disadvantages found in prior art devices in which the electrical elements are embedded in an insulating coating mass is an undesirable variation in time delay, resulting from differences in environmental temperature requiring more or less heat to raise the embedding mass to the critical temperature of the thermally responsive device. Further, the space between the heater and thermally responsive elements must be held within close tolerances to avoid variation in delay time due to differences in length of the heat conducting path through the embedding mass.

The body covering the functional electrical elements of the assembly may be made optically opaque to discourage possible tampering or bypassing of the internal assembly circuit after visual analysis. Moreover, the thermally responsive element itself may be constructed in a manner which prevents its condition of electrical continuity to be determined by visual inspection. As a result, electrical testing equipment has been required to determine the condition of a thermally responsive element, or an assembly in question has had to be replaced by a new unit at a substantial risk of the latter's being destroyed if it was of one-time use construction.

SUMMARY OF THE INVENTION

The thermal limiter assembly of the invention includes selected components having certain related properties and cooperative functions resulting in improved performance characteristics. More specifically, in accordance with one aspect of the invention, the heater and thermally responsive elements are mounted within a gas-filled housing body and have a heat transfer relationship substantially unaffected by external environmental temperatures. The low mass and specific heat of the gas within the housing avoid large and variable heating losses within the housing due to ambient temperature variations. Further, the absence of a shielding mass between the heater and thermally responsive elements allows a substantial portion of the heat to be efficiently transferred by radiation, so that variation in performance due to differences in spacing of the elements is also reduced. It has been found that air is satisfactory for use as a gas medium in the housing, thereby saving material, weight, and cost.

According to another important aspect of the invention, the thermal limiter includes means for indicating the conductivity state of the thermally responsive element by visual inspection external of the housing. As disclosed, the indicating means includes a heat transfer relationship between the heater and housing wall which is thermally analogous to that between the heater and thermally responsive element, whereby a heat-induced physical change is produced on the wall. The physical change results from localized heating of a wall of the housing body immediately adjacent the heater to a temperature at least as high as its melting temperature. Ideally, in accordance with the invention, the various elements are arranged such that a local housing wall area reaches its melting temperature substantially simultaneously with the point in time that the thermally responsive element reaches its critical temperature. The body is preferably hermetically sealed so that the gas pressure developed within the body upon heating is employed to expand the locally heated wall portion outwardly so that a readily observed and unmistakable protrusion is formed on the body, indicating that the thermally responsive element has reached its critical temperature.

BRIEF DESCRIPTION OF THE DRAWING

FIG. 1 is a perspective view of a thermal limiter assembly constructed in accordance with the invention;

FIG. 2 is a perspective view of the assembly, with portions of a housing body broken away to reveal details of the functional electrical elements;

FIG. 3 is a cross sectional view of the thermal limiter assembly taken along the line 3—3 in FIG. 1;

FIG. 4 is a perspective view similar to FIG. 1, showing the thermal limiter in a condition indicating that the thermally responsive element has reached its critical temperature;

FIG. 5 is a representative, schematic electrical diagram in which the thermal limiter is employed.

FIG. 6 is a perspective fragmentary view similar to FIG. 4 with the thermal limiter indicating the condition of the thermally responsive element is a second manner; and FIG. 7 is a sectional view of the thermal limiter of FIG. 6 taken along the line 7—7.

DESCRIPTION OF THE PREFERRED EMBODIMENT

A thermal limiter assembly 10 embodying the invention includes a housing body 11 in which are mounted functional electrical elements in the form of a heater element 12 and a thermally responsive element 13. The elements 12 and 13 are adapted to be connected in an external circuit by means of terminals 14–16 projecting from the housing body 11 and internally connected to the elements.

The housing body 11 preferably is molded of a suitable optically opaque thermoplastic material. The body 11, as shown, is a generally rectangular, hollow block having five rectangular integral faces or walls and an integral tab 17 for mounting the assembly 10. A remaining or sixth side of the housing body 11 is closed by a rigid wall 21 seated in a peripheral groove or recess 22 formed in the adjacent sidewalls of the housing body. The rigid wall 21 is conveniently formed of conventional electrically insulating terminal board stock, and is suitable for service in a moderately high temperature environment, and may, for example, be formed of conventional phenolic or other thermosetting resin-impregnated material. The wall 21 and terminals 14–16 are coated with an outer electrically insulating layer of suitable sealant, such as an epoxy casting resin 23, to hermetically seal a rectangular cavity 24 formed by the walls of the housing body 11. The wall 21 and/or sealant 23 are preferably optically opaque. The electrically conductive terminals 14–16 are stamped or otherwise formed from flat metal stock and are positioned in suitable individual slots in the rigid wall 21. The terminals 14–16 are held in a coplanar array perpendicular to the rigid wall 21 by a friction fit in their associated slots and are subsequently secured in this position by deposition and hardening of the coating layer 23.

The heater element 12 comprises a suitable resistance wire 31 wound on a core 32 of fiberglass or other high temperature-resistant material in a conventional manner. The heater 12 is an elongated element having a longitudinal axis 30 extending generally parallel to the direction of the major length of the rectangular housing body 11. The ends of the heater core 32 and wire 31 are securely gripped by rolled portions of the outwardly spaced terminals 14 and 16. The terminals 14 and 16 thereby support the heater 12 and provide electrical continuity with the heater wire 31.

The thermally responsive element may be of the general type illustrated in U.S. Pat. No. 3,180,958 to Merrill. In connection with the disclosure hereinbelow, the thermally responsive element is assumed to be a one-shot or single-use fuse or switch type element which is normally conductive or closed and which becomes nonconductive or open upon reaching a critical temperature. Other arrangements wherein the thermally responsive element is normally open and becomes closed or conductive when reaching a critical temperature are also within contemplation of the invention. The thermally responsive element 13 includes a cylindrical body 35 and a pair of conductor wires 36 and 37. Ends of the wires 36 and 37 distal from the body 35 are welded or otherwise secured to an end terminal 16 in common with the heater 12 and the central terminal 15, respectively. The wires 36 and 37 are sufficiently rigid to support the body 35 in a fixed, spaced relationship relative to the heater element 12, such that a longitudinal axis 38 of the thermally responsive element 13 is substantially parallel to the heater axis 30. As disclosed in the aforementioned Merrill patent, electrical continuity between the wires 36 and 37 is provided in the body 35 until a critical elevated temperature is reached therein, at which point continuity is interrupted.

With the end terminals 14 and 16 crimped on the parts 31 and 32 of the heater element 12 and the conductor wires or leads 36 and 37 bent to a proper configuration, the wires may be welded to the associated terminals 15 and 16. With the resulting subassembly of the heater 12, thermally responsive element 13 and terminals 14–16 fabricated, the terminals may be conveniently positioned through the appropriate slots in the terminal board or end wall 21. The heater 12 and thermally responsive element 13 are thereafter positioned in the housing body cavity 24 and, with the terminal board 21 seated in the groove 22, the sealant 23 is applied. The cavity 24 is conveniently sealed while containing a gas such as air at atmospheric pressure and normal room temperature.

As viewed in FIG. 3, the terminals 14 and 16 support the heater 12 in parallel, spaced relation to adjacent housing body wall portions 41 and 42. The spacing between the heater 12 and the wall portion 41 is approximately the same as the spacing between the heater 12 and thermally responsive element 13.

An example of a circuit 46 in which the thermal limiter assembly 10 is employed is illustrated in FIG. 5. The circuit 46 represents a portion of a control circuit for an automotive air conditioning system. A coil of an electrically operated drive clutch for an air conditioning compressor is indicated at 47. The coil 47 is intermittently energized by a suitable power source, such as the storage battery, designated 48, of the automobile upon the closing of a conventional thermostatically controlled switch 49 connected in series between the battery and the center terminal 15 of the thermal limiter 10. As seen in FIG. 5, current from the battery 48 is conducted from the central terminal 15 through the thermally responsive device 13 to the common end terminal 16 and thence to the coil 47 by a conductor 51. Thus, when the switch 49 is in the illustrated closed position, the coil 47 is energized and the compressor is driven in a conventional manner.

A second switch 52 is associated with a sensor which detects a loss of charge of refrigerant in the air conditioning refrigerant system. As indicated, the switch 52 is normally open but, upon loss of refrigerant, closes to connect an associated end terminal 14 of the thermal limiter 10 to ground. Closure of the switch 52 thereby permits current to flow through the heater element 12.

Upon energization of the heater element 12, the atmosphere within the cavity 24, the thermally responsive element 13, and the interior surfaces of the housing body walls begin to increase in temperature. Ideally, the heater 12 is selected in relation to the voltage potential applied by the power source 48 to give off a substantial amount of its heat by radiation to the various surfaces within or bounding the cavity 24. Since, as illustrated, the space between the heater 12 and thermally responsive element 12 is relatively small in comparison to their respective axial lengths, the heat transfer relationship therebetween by radiation is not greatly affected by a slight variation in spacing between these elements. Similarly, heat transfer by radiation between the heater 12 and adjacent wall portions 41 and 42 is not unduly affected by slight variations in spacing. The housing body 11 is preferable formed of a material having a dark color such as black or dark brown to enhance its heat absorption while the body 35 of the thermally responsive element is externally plated with silver.

Within a predetermined time, the thermally responsive element 13 is raised to a critical elevated temperature, at which point it becomes nonconducting, thereby disconnecting the battery 48 from both the clutch coil 47 and heater 12. As a result, the compressor clutch associated with the coil 47 is de-energized, thereby disengaging the compressor and protecting it from permanent damage resulting from a lack of lubrication associated with a loss of refrigerant. The thermal limiter 10 is thus responsive to a sensed or specific condition, i.e., the loss of refrigerant indicated by closure of the sensor switch 52 to alter the circuit of the compressor coil 47. The time delay provided by the thermal lag of the thermally responsive element 13 is not substantially affected by variations in ambient temperature, since the gas occupying the cavity 24 has relatively little heat capacity, and therefore does not act as a heat sink in relatively low temperature environments.

Under certain conditions, the loss of charge sensor switch 52 may temporarily close for a period of time less than that which would be required for the compressor to incur damage through a lack of lubrication. So that the thermal limiter or control device 10 ignores such a circumstance, the wattage capacity of the heater 12 is selected such that it cannot elevate the temperature of the thermally responsive element 13 to its critical temperature within the period of time during which a false signal at the switch 52 normally persists. Stated in other words, the thermal response of lag of the element 13 provides a time delay longer than the duration of an expected transient condition.

The termination of heat transfer by radiation and conduction from the heater element 12 to the thermally responsive element 13 is relatively fast upon opening of the sensor switch 52, since the heat stored in the heater element and the surrounding gas atmosphere is relatively limited. This characteristic substantially avoids control problems associated with thermal overshoot, where, after the heater element 12 is de-energized, excessive heat storage within the housing would shortly thereafter cause unwanted actuation of the thermally responsive element 13.

In accordance with an important aspect of the invention, the heat transfer relationship between the heater 12 and the wall portions 41 and 42 of the housing body 11 is thermally analogous or equivalent to that between the heater and thermally responsive element 13 so that the temperature of these adjacent wall portions increases simultaneously with the increase in temperature of the thermally responsive element. Preferably, the wall portions 41 and 42, by virtue of their heat transfer relationship with the heater 12 and their heat capacity, are adapted to reach a flow or deflection temperature simultaneously with the point in time at which the thermally responsive element 13 reaches its critical temperature. Elevation of the wall portions 41 and 42 to their flow temperature and a resulting physical change on these wall portions thereby provide a means of externally indicating the conductivity state of the thermally responsive element 13. Specifically, reaching of the flow temperature of the wall portions 41 and 42 causes a change or disturbance from their original generally planar configuration which is readily apparent by visual inspection. Where the cavity 24 is hermetically sealed, the disturbance occurs as a blister or bubble 56 on each wall portion 41 and 42 (only that associated with the wall 41 is illustrated in FIG. 4) formed by an increase in pressure of the gas in the cavity 24. The disturbance 56 thereby displays an externally perceptible indication of the condition of the thermally responsive element 13, despite the fact that the housing body 11 and closure formed by the coating 23 and wall 21 are opaque. The blister 56 solidifies upon the circuit breaking action of the thermally responsive element 13 and subsequent cooling of the heater 12, to become a permanent record of the state of the thermally responsive element.

Referring to FIGS. 6 and 7, where the housing cavity 24 is vented to the atmosphere as by a vent hole (not shown) indication of the conductivity state of the thermally responsive element 13 is given by a disturbance 61 on the housing wall 41. The disturbance 61 is in the form of a generally elliptical area on the sidewall 41 which including the outer surface is heated by the heater element 12 to a temperature sufficient to cause free flow of the local wall material and the creation of a permanent "wet look" or shiny surface in comparison to the grainy or matte finish of the original as molded condition of the sidewall. The area 61 is further distinguished by a general waviness or nonplanar outer surface having deviations from a plane at least in the order of magnitude of the thickness of the sidewall 41 (FIG. 7).

For use in a 12 volt automotive system the following table sets forth the properties of a typical thermal limiter assembly constructed in accordance with the invention. The relative proportions of the various parts of the assembly 10 are shown substantially to scale in FIGS. 1–4 and 6.

| | |
|---|---|
| Housing body dimensions (excluding mounting tab and tabs on bottom face, H, W, and L respectively) | .53 × .60 × 1.40 inches |
| Housing body material | suitable molding nylon e.g. nylon 6 |
| Housing body wall thickness | .05 inches sidewalls<br>.06 inches bottom wall |
| Nominal melting temperature of housing body material | 410–430° F (approx.) |
| Housing body color | black or dark brown |
| Nominal heater resistance | 11.2 ohms |
| Nominal heater wire size | .008 inches diameter by 9.63 inches long wound between terminals |
| Space between heater and thermally responsive elements | .110 inches |
| Critical temperature of thermally responsive element | 167° C (333° F) |

What is claimed is:

1. A circuit control device comprising a housing of thermoplastic material, a thermally responsive element in said housing adapted to change its state of conductivity when heated to a predetermined temperature, a heater element in the housing arranged to be electrically energized to raise the temperature of said thermally responsive element, a plurality of electrical terminals selectively connected to said heater element and said thermally responsive element whereby said heater element is arranged to be energized by an electrical source of energy external of said housing and said thermally responsive element is arranged to alter a circuit connected to said terminals, said housing defining a cavity, said heater element and said thermally responsive element being disposed in said cavity, substantially all of said cavity not occupied by said elements being occupied by a gas, a wall of said housing including an outer surface adapted to undergo a physical change perceptible externally of the housing when heated to a critical flow temperature, said heater being arranged in heat transfer relationship relative to said thermally responsive element and said wall such that said outer surface of said wall reaches said critical flow temperature and said physical change occurs at substantially the same time said thermally responsive element reaches said predetermined temperature and said change in conductivity state occurs whereby visual inspection of said housing wall reveals the condition of said thermally responsive element, said heater element being adapted to heat said wall by substantial radiation energy transfer.

2. A circuit control device comprising a housing of thermoplastic material, a thermally responsive element in said housing adapted to change its state of conductivity when heated to a predetermined temperature, a heater element in the housing arranged to be electrically energized to raise the temperature of said thermally responsive element, a plurality of electrical terminals selectively connected to said heater element and said thermally responsive element whereby said heater element is arranged to be energized by an electrical source of energy external of said housing and said thermally responsive element is arranged to alter a circuit connected to said terminals, a wall of said housing including an outer surface adapted to undergo a physical change perceptible externally of the housing when heated to a critical flow temperature, said heater being arranged in heat transfer relationship relative to said thermally responsive element and said wall such that said outer surface of said wall reaches said critical flow temperature and said physical change occurs at substantially the same time said thermally responsive element reaches said predetermined temperature and said change in conductivity state occurs whereby visual inspection of said housing wall reveals the condition of said thermally responsive element, said housing being a multisided, integrally molded structure, one face of said structure being closed by a separately formed wall element, said housing including an inner cavity in which said heater and thermally responsive elements are disposed, said cavity being occupied with a gas, said gas being confined within said cavity to cause a bubble to be formed on a sidewall of said integrally molded structure when the sidewall is elevated to said flow temperature.

3. A thermal limiter for controlling an electrical circuit comprising a multisided thin walled integrally molded body of thermal plastic material, a rigid separately formed wall carried on said body and closing off a cavity formed therein, said separately formed wall being formed of a material suitable for service in elevated temperatures, a thermally responsive element and a heater element supported in spaced relationship therebetween in said cavity by said wall, electrical connector means extending through said separately formed wall for connecting said elements in said electrical circuit, said heater element being adapted to be electrically energized through said connectors, said thermally responsive element being adapted to change its state of conductivity upon reaching a predetermined temperature to thereby alter the continuity of a circuit connected to at least one of said connectors, said cavity having a volume substantially larger than the combined volumes of said heater element and said thermally responsive element and being occupied by a gas, said heater element being adapted to transfer a substantial portion of its heat by radiation through the gas in said cavity to said thermally responsive element and at least one of the sidewalls of said body, said one sidewall having an area adjacent said heater element adapted to reach a flow temperature and exhibit a resulting physical change on its outer surface, the relative spacing of said heater element to said thermally responsive element and said one sidewall being selected such that the heat transfer relationship between said heater element and said thermally responsive element and between said heater element and said one sidewall are thermally analogous whereby said thermally responsive element is adapted to reach said predetermined temperature substantially simultaneously with the elevation of said one sidewall to its flow temperature such that the resulting physical change on the outer surface of the sidewall indicates the state of conductivity of said thermally responsive element, said cavity being hermetically sealed by a coating applied to an outer side of said separately formed wall, expansion of the gas in said cavity upon energization of said heater element being adapted to cause said adjacent area of said one sidewall to bubble outwardly of the plane of said sidewall.

4. A thermal limiter set forth in claim 3 wherein said coating on the outer side of said separately formed wall fixes the position of said connectors on said separately formed wall.

* * * * *